US005881687A

United States Patent [19]

Sakaguchi et al.

[11] Patent Number: 5,881,687

[45] **Date of Patent: *Mar. 16, 1999**

[54] TWO-STROKE INTERNAL COMBUSTION ENGINE

[75] Inventors: Yukio Sakaguchi, Saitama; Noboru Nagai, Tokyo; Shigeru Sato, Saitama; Yasuharu Sato, Tokyo, all of Japan

[73] Assignee: Kioritz Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 827,651

[22] Filed: Apr. 10, 1997

[30] Foreign Application Priority Data

Apr. 16, 1996 [JP] Japan ..... 8-094451

[51] Int. Cl.[6] ..... F02B 23/00

[52] U.S. Cl. ..... 123/65 R; 123/73 PP; 123/65 A

[58] Field of Search ..... 123/65 R, 65 A, 123/73 PP, 65 P

[56] References Cited

U.S. PATENT DOCUMENTS

| | | | |
|---|---|---|---|
| 3,074,388 | 1/1963 | Kruckenberg | 123/65 R |
| 3,680,305 | 8/1972 | Miller | 123/65 R |
| 4,445,467 | 5/1984 | Westerman et al. | 123/65 R |
| 4,922,865 | 5/1990 | Kumagai et al. | 123/65 VC |
| 5,020,487 | 6/1991 | Kruger | 123/65 R |
| 5,048,473 | 9/1991 | Curtil | 123/65 A |

*Primary Examiner*—Noah P. Kamen
*Attorney, Agent, or Firm*—Baker & Botts, L.L.P.

[57] ABSTRACT

In a two-stroke internal combustion engine, output power is increased and total hydrocarbon (THC) exhaust is decreased as a result of small structural changes. An exhaust port and scavenging ports are configured and disposed such that they are open in a reduced period of the combustion cycle.

4 Claims, 9 Drawing Sheets

TWO-STROKE INTERNAL COMBUSTION ENGINE

BACKGROUND OF THE INVENTION

1. Field of the Invention

The present invention relates to a small air-cooled two-stroke gasoline engine having a displacement of about 15 cc to about 35 cc which is preferably used in a small-sized hand-held working machine such as a brush cutter or chain saw. More particularly, it relates to a small air-cooled two-stroke gasoline engine which is designed so as to reduce noxious pollutants in an exhaust gas, in particular, total HC (THC) without impairing output power characteristics.

2. Description of the Prior Art

Recently, due to increased environmental awareness, even with respect to a small air-cooled two-cycle gasoline engine which is used in a hand-held working machine such as a brush cutter or chain saw, it has been strongly desired to render an exhaust gas discharged therefrom less pollutive by reducing noxious pollutants such as HC, CO and NOx in the exhaust gas. For example, according to the regulation of exhaust gas bill in the State of California, i.e., so-called CARB 1999, it is required to reduce CO, total HC (THC) and NOx contents of an exhaust gas to not higher than 130 g/bhp-h, 50 g/bhp-h and 4 g/bhp-h, respectively, from 1999 onward.

FIGS. 8 and 9 show an example of a conventional small air-cooled two-stroke gasoline engine which has been subject to a demand for reduction of noxious pollutants contained in an exhaust gas.

The illustrated internal combustion engine 1' is a Schn ürle scavenging type small air-cooled two-stroke gasoline engine which is incorporated as a power source into a hand-held working machine such as a brush cutter or chain saw and whose displacement is about 23 cc. The internal combustion engine 1' comprises a cylinder 2' having a combustion chamber 5' equipped with a spark plug 15, a crank case 3 connected to the bottom of the cylinder 2', and a piston 4' fit-inserted in the cylinder 2'. In the cylinder 2', an intake port 7 connected to a carburetor (not shown) and an exhaust port 10' are formed so as to open oppositely at different levels, and a pair of scavenging ports 9' 9' ' are formed symmetrically with respect to the longitudinal sectional plane bisecting the exhaust port 10' and the intake port 7. Opening and closing of these ports 10', 7 and 9', 9' are effected by the reciprocating movement of the piston 4'.

As in a customary internal combustion engine, reciprocating motion of the piston 4' is converted into rotational motion of a crank shaft 12, on which a balance weight 14 is mounted, via a connecting rod 11, and the output power from the crank shaft 12 is utilized as a driving force of the hand-held working machine.

In the internal combustion engine 1', during a reciprocation, i.e., two strokes of the piston 4', steps of compression, combustion, intake, scavenging, expansion and exhaust are effected in a well-known manner as a consequence of the vertical reciprocation of the piston 4'. In the conventional engine 1', for example, as shown in the conceptional diagram of FIG. 6 (B), opening and closing of the exhaust port 10' and the scavenging ports 9', 9' by means of the piston 4' are timed, in view mainly of output power characteristics, such that the exhaust port 10' and the scavenging ports 9', 9' are open when the crank shaft 12 is within ranges covering an angle of 140 degrees and an angle of 107 degrees in terms of its crank angle, respectively, each of which centrally contains the bottom dead center (BDC). In other words, the exhaust port 10' and the scavenging ports 9', 9' are closed when the crank shaft 12 is outside the above respective ranges in terms of its crank angle.

As shown in FIG. 5 (B) which is an enlarged view of the combustion chamber 5' and its surroundings, the combustion chamber 5' is a squish dome type combustion chamber which comprises a substantially conical main surface 5*a'* and an annual skirt-like squish band 5*b'* gently sloping and having a relatively large band width α' (maximum width: 8 mm, minimum width: 3 mm). The combustion chamber 5' is equipped with a spark plug 15' in the conical surface opposite to the exhaust port 10' in such a manner that a spark point SP' of the spark plug 15' is located nearer to the exhaust port 10' than the center line C of the combustion chamber 5'.

Further, as shown in FIG. 5 (B), a distance L' between the top surface 4*a'* of the piston 4' and the upper edge 4*b'* of a groove for retaining the upper piston ring 21' of piston rings is about 2.5 mm, and each of the piston rings 21', 22' has a thickness d' of about 2.0 mm.

In the conventional small air-cooled two-stroke gasoline engine 1' as described above which is used in a portable working machine, a fresh gas mixture (air-fuel mixture) is in part directly swept toward an exhaust port 10' and discharged therefrom, so that a so-called "blow through" amount is undesirably large. This leads to unsatisfactory fuel consumption. Further, it is extremely difficult to reduce pollutants contained in an exhaust gas, in particular, THC. To date, there have not yet been developed any practically effective measures to cope with these problems.

SUMMARY OF THE INVENTION

The present invention has been made in view of these problems. It is ,therefore, an object of the present invention to provide a two-stroke internal combustion engine which enables increased output power to be realized and is capable of effectively reducing THC content without any considerable structural change.

To attain the above object, in a two-stroke internal combustion engine 1 of a Schnurle scavenging type which is provided with an exhaust port and scavenging ports, the present invention is derived from a conception to control timing of opening and closing of the exhaust port and the scavenging ports by means of a piston, and the timing is controlled in such a manner that commencements of the opening of the exhaust port and the scavenging ports are delayed to respective possible extents. More specifically, the opening and closing of the exhaust port and the scavenging ports by means of the piston are timed such that the exhaust port and the scavenging ports are open when the crank shaft is within ranges covering an angle of 110–120 degrees and an angle of 85–100 degrees in terms of its crank angle, respectively, each of which centrally contains the bottom dead center (BDC).

The opening and closing of the exhaust port and the scavenging ports with such timing are attained by virtue of the lowered positions of the upper ends of the exhaust port and the scavenging ports and the reduced distance between the upper end of the exhaust port and the upper end of each of the scavenging ports.

In a conventional internal combustion engine of this type, opening and closing of an exhaust port and scavenging ports are generally timed, in view mainly of output power characteristics, such that the exhaust port and the scavenging ports are open when a crank shaft is within the ranges covering an angle exceeding 130 and not exceeding 150 degrees and an angle exceeding 100 and not exceeding 110 degrees in terms of its crank angle, respectively, as described above, whereas in the present invention, the respective ranges are as described above. Accordingly, the exhaust port and the scavenging ports are opened later in a descending stroke of the piston and closed earlier in an ascending stroke of the piston as compared with those in the conventional internal combustion engine.

Consequently, explosion energy is sufficiently converted into force urging the piston downward by exhaust initiation when the exhaust port commences to open. This results in lowered exhaust gas pressure. Accordingly, scavenging gas flow does not yield to back pressure, and thus flow velocity of the scavenging gas flow is increased. In consequence, scavenging is carried out effectively.

By virtue of such effective scavenging, "blow through" amount is reduced and THC content of an exhaust gas is reduced. In addition, output power is raised. These effects are attained just by changing the shapes and positions of the exhaust port and scavenging ports. This does not lead to increased cost.

BRIEF DESCRIPTION OF THE DRAWINGS

FIG. 5 (B) is an enlarged view showing a combustion chamber and its vicinity of the conventional internal combustion engine shown in FIG. 8;

FIG. 6 (B) is a diagrammatic view illustrating timing of opening and closing of an exhaust port and scavenging ports of the conventional internal combustion engine shown in FIG. 8;

DESCRIPTION OF THE PREFERRED EMBODIMENT

Figure 1:
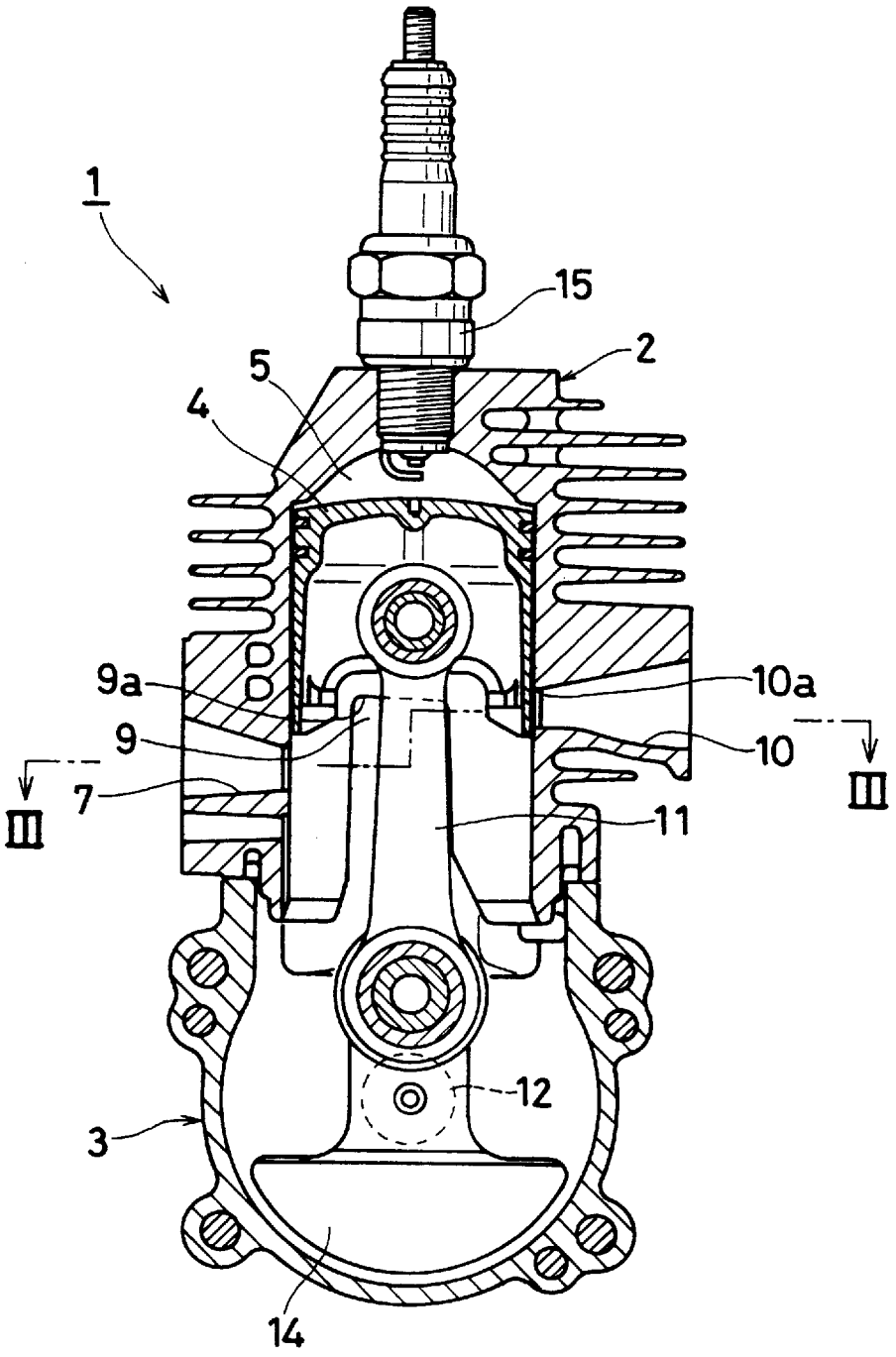
FIG. 1 is a bisectional view of an embodiment of the two-stroke internal combustion engine according to the present invention, which is taken across a crank shaft.
Figure 2:
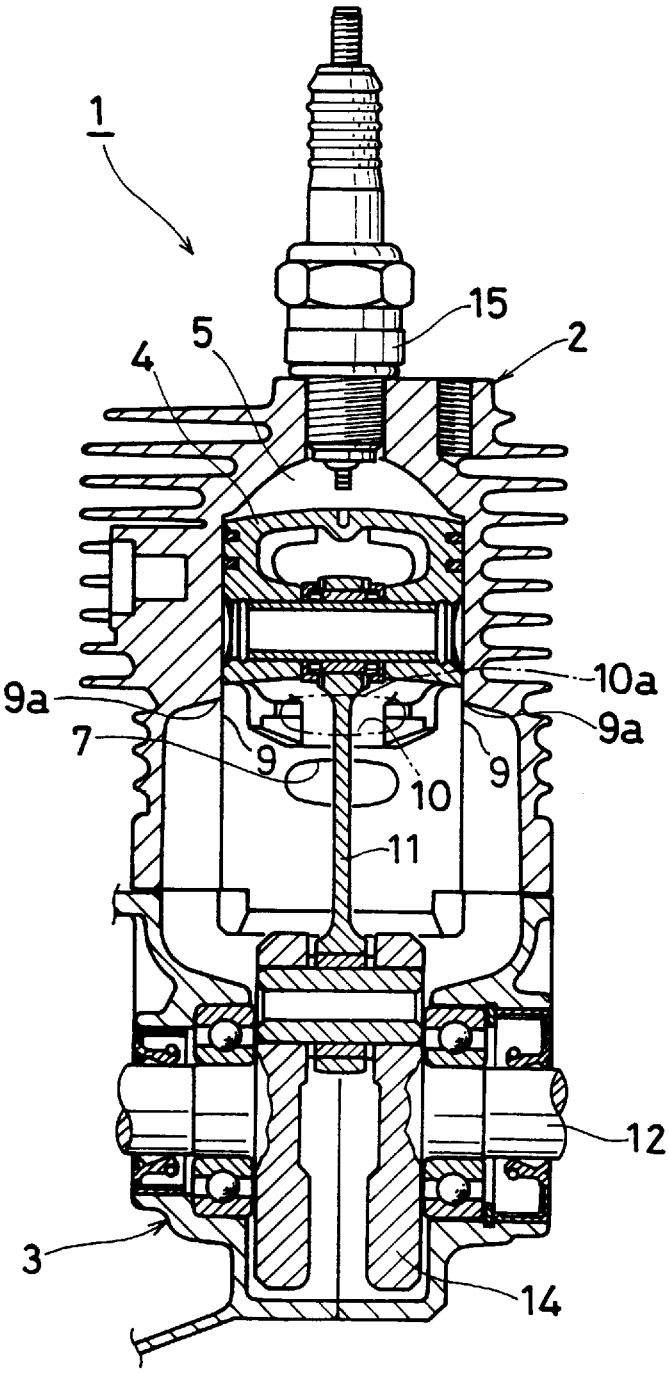
FIG. 2 is a bisectional view of the embodiment of the two-stroke internal combustion engine shown in FIG. 1, which is taken along the crank shaft.

In the following, an embodiment of the present invention will be described with reference to the accompanying drawings. FIGS. 1 and 2 show a small air-cooled two-stroke gasoline engine (hereinafter referred to simply as internal combustion engine) as an embodiment according to the present invention. The illustrated internal combustion engine 1 is a Schnürle scavenging type internal combustion engine which is incorporated as a power source into a hand-held working machine such as a brush cutter or chain saw and whose displacement is about 23 cc.

Figure 3:
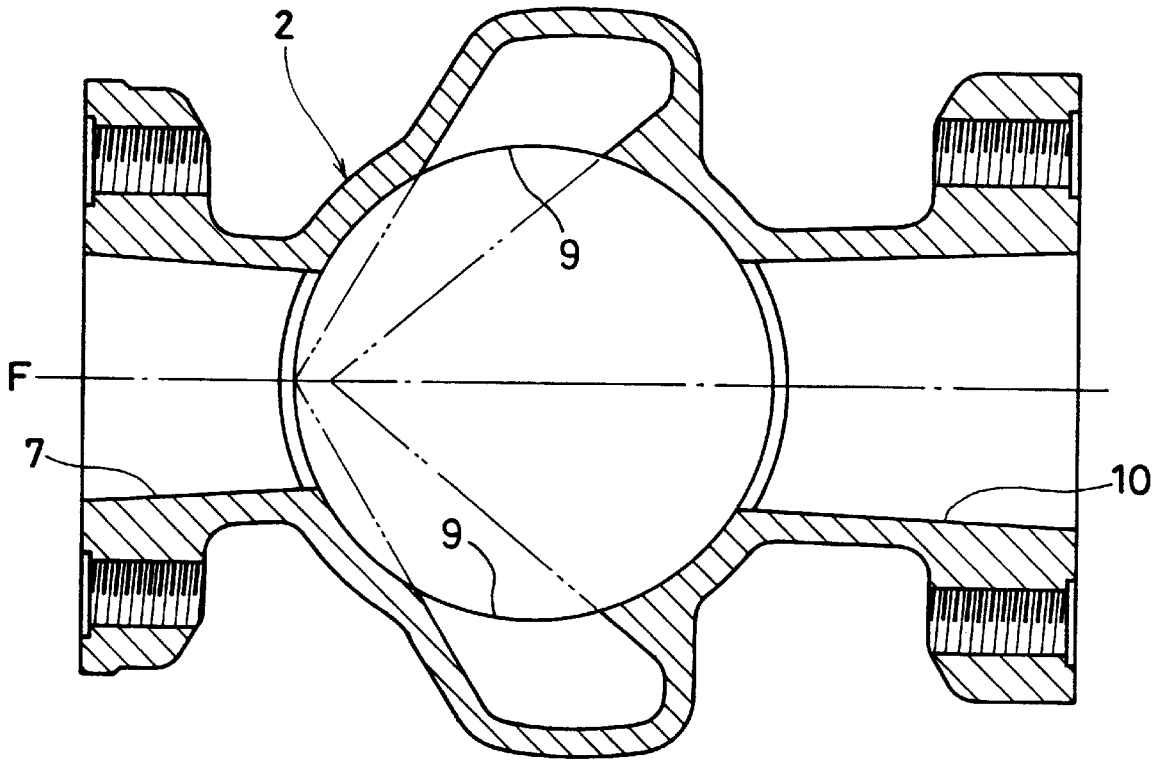
FIG. 3 is a sectional view taken along the line III—III and viewed in the direction of the arrows in FIG. 1.

As in the above-described conventional internal combustion engine 1', the internal combustion engine 1 according to the present invention comprises a cylinder 2 having a combustion chamber 5 equipped with a spark plug 15, a crank case 3 connected to the bottom of the cylinder 2, and a piston 4 fit-inserted in the cylinder 2. In the cylinder 2, an intake port 7 connected to a carburetor (not shown) and an exhaust port 10 are formed so as to open oppositely at different levels, and as shown in FIG. 3, a pair of scavenging ports 9, 9 are formed symmetrically with respect to the longitudinal sectional plane F bisecting the exhaust port 10 and the intake port 7 opening and closing of these ports 10, 7, and 9, 9 are effected by the reciprocating movement of the piston 4.

Further, as in the conventional internal combustion engine 1', reciprocating motion of the piston 4 is converted into rotational motion of a crank shaft 12, on which a balance weight 14 is mounted, via a connecting rod 11, and the output power from the crank shaft 12 is utilized as a driving force of the hand-held working machine.

Figure 6:
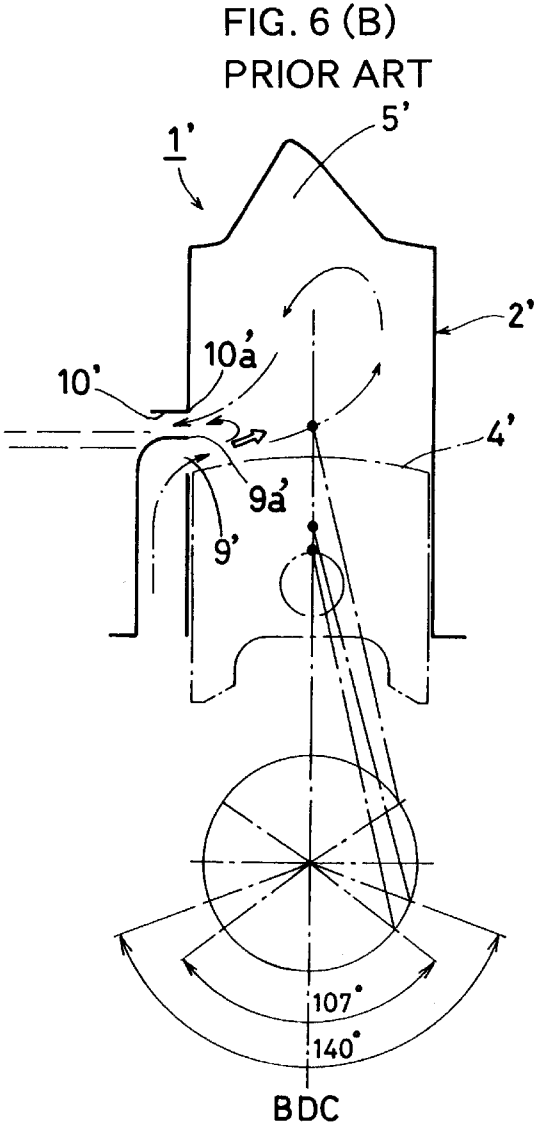
FIG. 6 (B) PRIOR ART
FIG. 6 (A) is a diagrammatic view illustrating timing of opening and closing of an exhaust port and scavenging ports of the embodiment of the internal combustion engine according to the present invention shown in FIG. 1. (For convenience of explanation, the scavenging port is shown as being positionally shifted in the horizontal direction in an angular amount of 90 degrees. The same is true of FIG. 6 (B))
Figure 6:
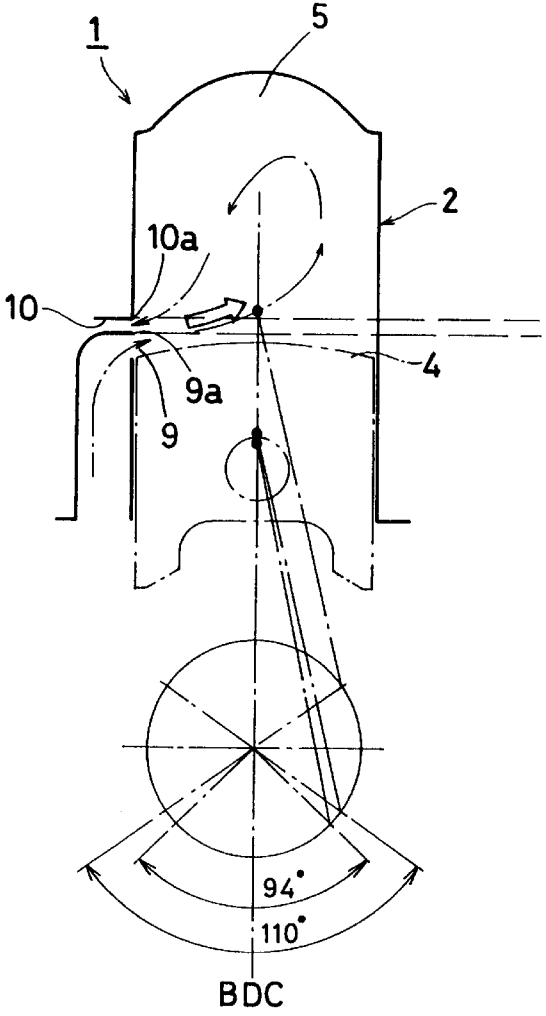

In the internal combustion engine 1, during a reciprocation, i.e., two strokes of the piston 4, steps of compression, a combustion, intake, scavenging, expansion and exhaust are effected in a well-known manner as a consequence of the vertical reciprocation of the piston 4. In the internal combustion engine 1, as shown in the conceptional diagram of FIG. 6 (A), opening and closing of the exhaust port 10 and the scavenging ports 9, 9 by means of the piston 4 are timed such that the exhaust port 10 and the scavenging ports 9, 9 are open when the crank shaft 12 is within ranges covering an angle of 110 degrees and an angle of 94 degrees in terms of its crank angle, respectively, each of which centrally contains the bottom dead center (BDC). In other words, the exhaust port 10 and the scavenging ports 9, 9 are closed when the crank shaft 12 is outside the above respective ranges in terms of its crank angle.

Figure 4:
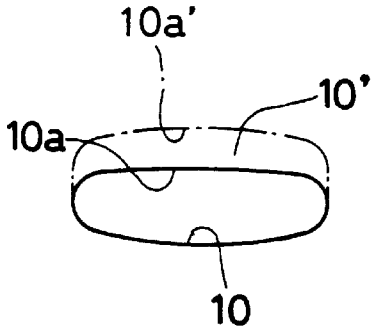
FIG. 4 is an illustrative view comparatively showing an exhaust port of the embodiment of the two-stroke internal combustion engine according to the present invention shown in FIG. 1 and that of the conventional internal combustion engine shown in FIG. 8.

In this embodiment, opening and closing of the exhaust port 10 and the scavenging ports 9, 9 with such timing are attained by virtue of the lowered positions of the upper ends 10*a* and 9*a*, 9*a* of the exhaust port 10 and the scavenging ports 9, 9, and the reduced distance between the upper end 10*a* of the exhaust port 10 and the upper end 9*a* of each of the scavenging ports 9, 9 in the vertical direction. In this connection, FIG. 4 shows superimposition of the exhaust port 10 (shown by solid line) of this embodiment and the exhaust port 10' (shown in phantom) of the conventional engine. As shown the position of the upper end 10*a* of the exhaust port 10 of this embodiment is considerably lower than that of the upper end 10*a* of the conventional exhaust port 10'.

In the conventional internal combustion engine 1', opening and closing of the exhaust port 10' and the scavenging ports 9', 9' are timed such that the exhaust port 10' and the scavenging 9', 9' are open when the crank shaft 12 is within the ranges covering an angle of 140 degrees and an angle of 107 degrees in terms of its crank angle, respectively, as described above, whereas in this embodiment, the respective ranges respectively cover an angle of 110 degrees and an angle of 94 degrees as described above. Accordingly, the exhaust port 10 and the scavenging ports 9, 9 are opened later in a descending stroke of the piston 4 and closed earlier in an ascending stroke of the piston 4 as compared with those in the conventional internal combustion engine 1'.

Consequently, explosion energy is sufficiently converted into force urging the piston 4 downward until exhaust initiation when the exhaust port 10 commences to open. This results in lowered exhaust gas pressure. Accordingly, scavenging gas flow does not yield to back pressure, and thus flow velocity of the scavenging gas flow is greatly increased as compared with the conventional engine 1', as shown by contoured arrows in FIGS. 6 (A) and 6 (B). In consequence, effective scavenging is attained.

Figure 7:
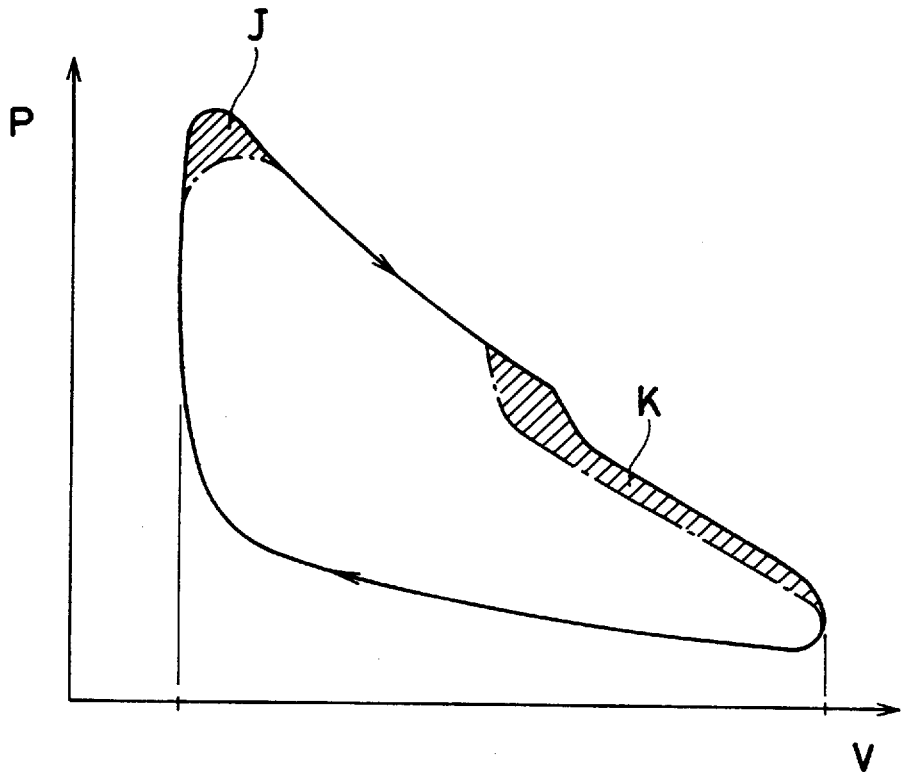
FIG. 7 is a diagrammatic representation illustrating output characteristics of the embodiment of the internal combustion engine according to the present invention shown in FIG. 1 and the conventional internal combustion engine shown in FIG. 8.
Figure 8:
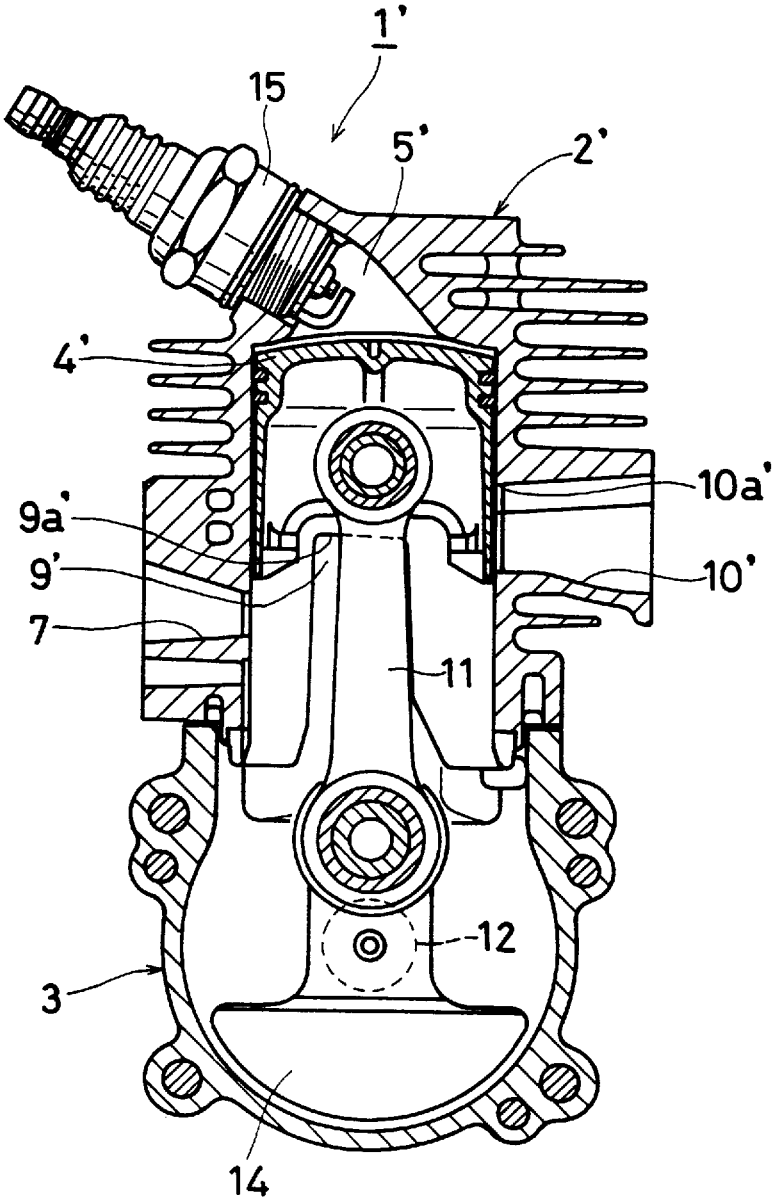
FIG. 8 PRIOR ART
FIG. 8 is a bisectional view of one form of a conventional two-stroke internal combustion engine, which is taken across a crank shaft
Figure 9:
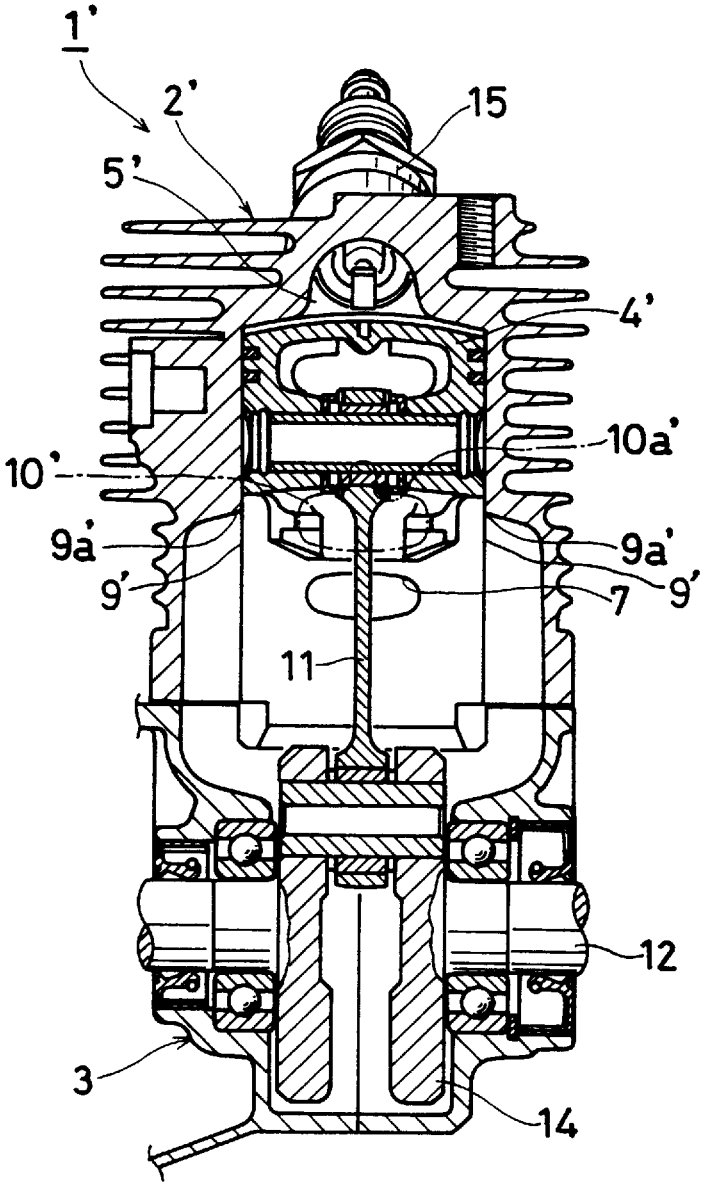
FIG. 9 PRIOR ART
FIG. 9 is a bisectional view of the form of the conventional two-stroke internal combustion engine shown in FIG. 8, which is taken along the crank shaft.

Such effective scavenging results in a reduced "blow-through" amount and reduced THC content of an exhaust gas, and leads to raised output power. FIG. 7 shows a PV diagram (Pressure-Volume diagram) for the engine 1 of this embodiment (shown by a solid line) and a PV diagram for the conventional engine 1' (shown in phantom), showing that output power of the engine 1 of this embodiment is raised with an increment corresponding to the hatched area K in FIG. 7 as compared with the conventional engine 1'. This is due to the narrowed ranges covering an angle of 110 degrees and an angle of 94 degrees for respectively opening the exhaust port 10 and the scavenging ports 9, 9.

These effects are attained just by changing the shapes and positions of the exhaust port 10 and scavenging ports 9, 9. This does not lead to increased cost.

Figure 5:
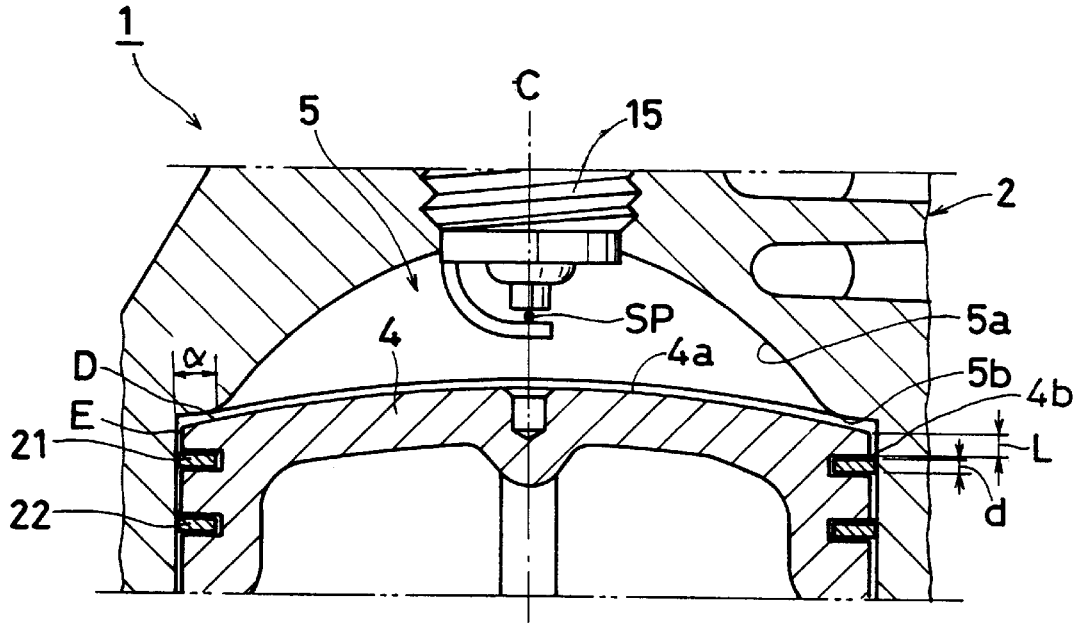
FIG. 5 (A) is an enlarged view showing a combustion chamber and its vicinity of the embodiment of the internal combustion engine according to the present invention shown in FIG. 1.
Figure 5:
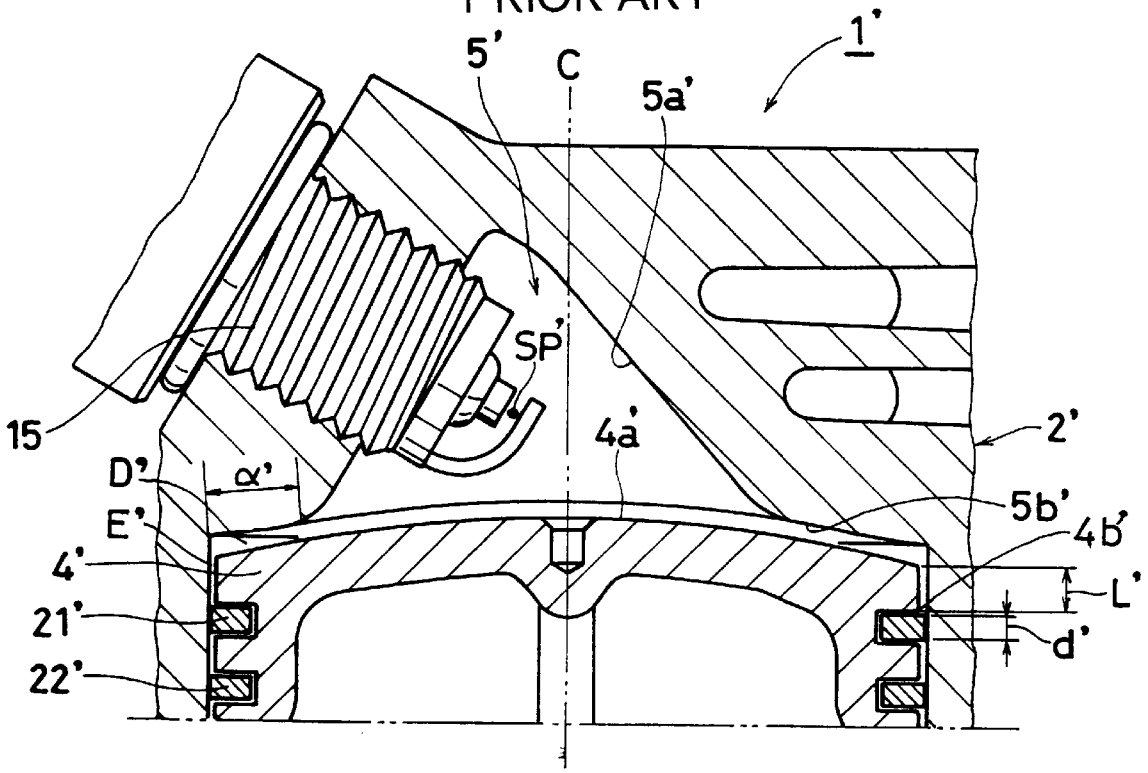
FIG. 5 (B) PRIOR ART

As shown in FIG. 5 (A) which is an enlarged view of the combustion chamber 5 and its vicinity, the combustion chamber 5 is a squish dome type combustion chamber which comprises a hemispherical main surface 5*a* concentric with the cylinder 2 and an annual skirt-like squish band 5*b* gently sloping and having a band width a (2 mm) considerably smaller than the band width $\alpha'$ of the conventional squish band 5*b*'. A spark plug 15 is mounted upright on the combustion chamber 5 along the center line C of the combustion chamber 5, so that a spark point SP (center electrode) of the spark plug 15 is located substantially at the center of the combustion chamber 5.

By virtue of the hemispherical configuration of the main surface 5*a* of the combustion chamber 5 and the location of the spark point SP of the spark plug 15 substantially at the center of the main surface 5*a* of the combustion chamber 5 as described above, an ideal mode of combustion is attained such that a flame propagates substantially simultaneously throughout the combustion chamber 5. Consequently, increased explosion pressure is attained and thus output power is raised. Specifically, output power of the engine 1 of this embodiment is raised with an increment corresponding to the hatched area J in the superimposed PV diagrams in FIG. 7 as compared with the conventional engine 1'.

Further, since the band width a of the squish band 5*b* is considerably smaller than the band width $\alpha'$ in the conventional internal combustion engine 1', a gallery gap D defined between the squish band 5*b* and the piston 4 at the top dead center (TDC) is considerably smaller than a gallery gap D' in the conventional internal combustion engine. Accordingly, the amount of unburnt gas mixture where flame propagation hardly reaches is small. In consequence, THC content of an exhaust gas is reduced.

Moreover, in this embodiment, a distance L between a top surface 4*a* of the piston 4 and an upper edge 4*b* of a groove for retaining an upper piston ring 21 of piston rings is as small as about 1.5 mm, and each of the piston rings 21, 22 has a thickness d as small as about 1.2 mm. In contrast thereto, in the conventional engine 1', a distance L' between a top surface 4*a*' of the piston 4' and an upper edge 4*b*' of a groove for retaining an upper piston ring 21' is about 2.5 mm, and each of the piston rings has a thickness d' of about 2.0 mm.

By reducing the distance L to 2.0 mm or smaller as in this embodiment, a gap E (where an unburnt gas mixture is collected) is reduced. The gap E is defined by the inner wall surface of the cylinder 2, the circumferential side surface of the piston 4 at the top dead center (TDC) and the upper piston ring 21 as shown in FIG. 5 (A). Accordingly, THC content of an exhaust gas is reduced. By reducing the thickness d of each of the piston rings 21, 22 to 1.5 mm or smaller, frictional loss due to friction between each of the piston rings 21, 22 and the inner surface of the cylinder 2 is reduced. In consequence, output power is raised.

Furthermore, the hemispherical combustion chamber 5 and the reduced band width a of the squish band 5*b* can provide for minimized burning gas contact area, thereby controlling heat loss to facilitate complete combustion.

To demonstrate the above-described effects, comparative experiments were conducted using the internal combustion engine 1 according to this embodiment of the present invention and the conventional internal combustion engine 1' under the same conditions. The results of the experiments are shown in FIG. 10.

Figure 10:
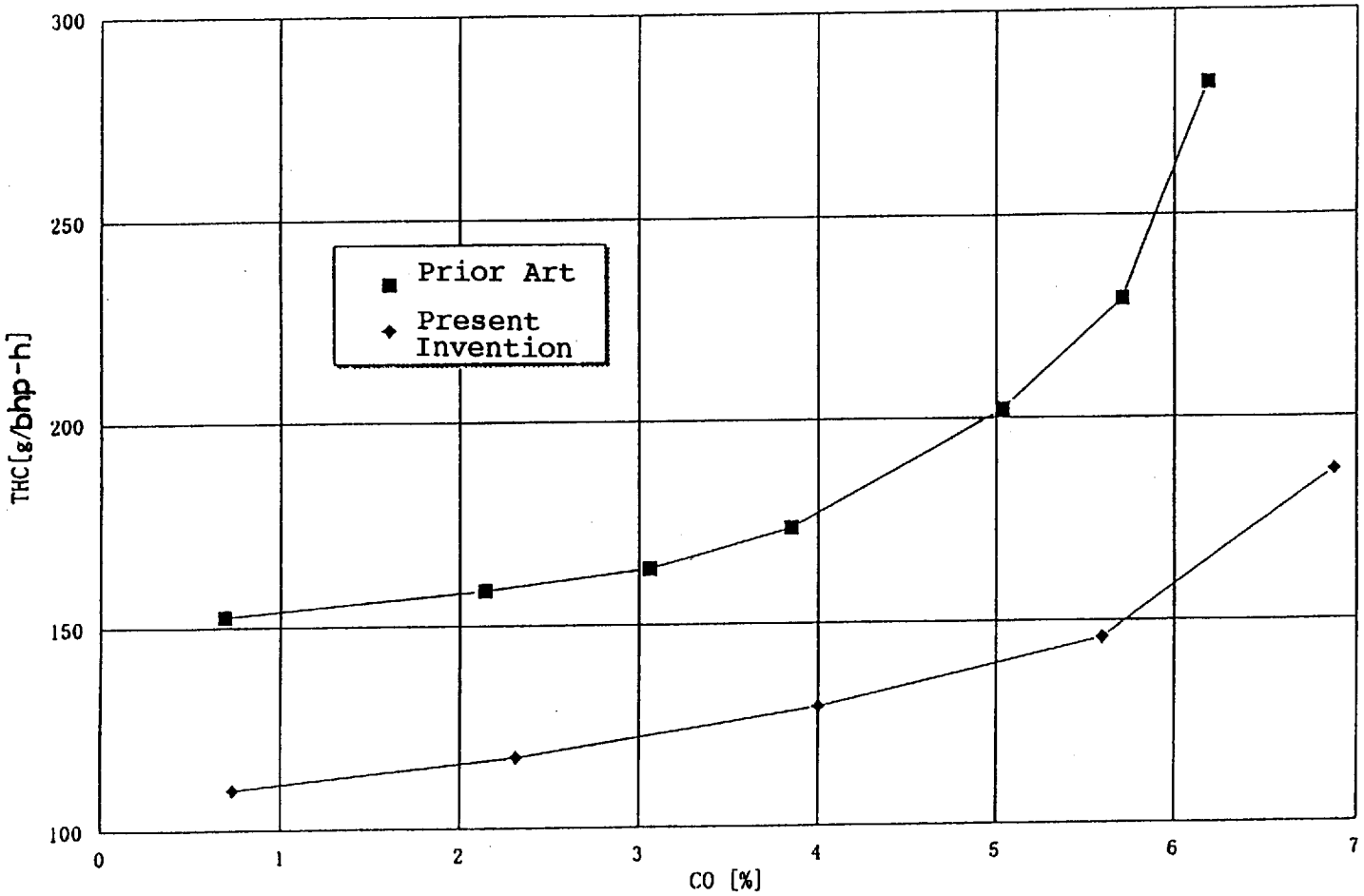
FIG. 10 is a graph showing results of comparative experiments on exhaust pollutant reducing characteristics of the embodiment of the two-stroke internal combustion engine according to the present invention shown in FIG. 1 and the conventional internal combustion engine shown in FIG. 8.

FIG. 10 shows that THC in the exhaust gas is greatly reduced in the internal combustion engine 1 according to this embodiment of the present invention as compared with the conventional engine 1'.

In the foregoing, one embodiment of the present invention has been described in detail. It is, however, to be understood that the present invention is by no means restricted to the above-described embodiment and that various modifications may be made within the scope which does not depart from the spirit of the present invention as defined in the claims.

For example, it is desired that opening and closing of the exhaust port and of the scavenging ports by means of the piston be timed such that the exhaust port and the scavenging ports are open when the crank shaft is within ranges covering an angle of 100–120 degrees and an angle of 85–100 degrees in terms of its crank angle, respectively, each of which centrally contains the bottom dead center (BDC). However, the ranges may be those covering angles not exceeding 130 degrees and 100 degrees to attain satisfactory effects, respectively.

As understood from the above description, according to the two-stroke engine of the present invention, excellent effects are obtained without involving any considerable structural change, in that output power is increased and THC in an exhaust gas is effectively reduced.

What is claimed is:

1. A two-stroke internal combustion engine comprising:

a crankshaft;

a cylinder having an intake port and an exhaust port; and a piston slidably disposed in the cylinder and operationally coupled to the crankshaft for turning the crankshaft in response to back-and-forth sliding motion of the piston in the cylinder;

wherein the exhaust port and the intake port are configured and disposed so as to be uncovered by the piston during respective first and second angular ranges of the crankshaft centered at bottom dead center, and, for minimized THC exhaust, with the first angular range not exceeding 130 degrees and the second angular range not exceeding 100 degrees.

2. The two-stroke internal combustion engine according to claim 1, wherein the first angular range does not exceed 120 degrees.

3. The two-stroke internal combustion engine according to claim 2, wherein the first angular range is at least 110 degrees.

4. The two-stroke internal combustion engine according to claim 1, wherein the second angular range is at least 85 degrees.

* * * * *

UNITED STATES PATENT AND TRADEMARK OFFICE

CERTIFICATE OF CORRECTION

PATENT NO. : 5,881,687

DATED : March 16, 1999

INVENTOR(S) : Sakaguchi et al.

It is certified that error appears in the above-identified patent and that said Letters Patent is hereby corrected as shown below:

Column 6, line 65, "a cylinder having an intake port and an exhaust port; and" should read -- a cylinder having an intake port for admitting a combustible mixture from a carburetor, an exhaust port, and at least one scavenging port for admitting scavenging gas; and --;

Column 5, line 4, "scavenging 9′, 9′" should read -- scavenging ports 9′, 9′ --;

Column 5, line 43, "a" (second occurrence) should read -- α --;

Column 5, line 62, "a" should read -- α --;

Column 6, line 27, "a" should read -- α --.

Signed and Sealed this

Eighteenth Day of July, 2000

*Attest:*

Q. TODD DICKINSON

*Attesting Officer*

*Director of Patents and Trademarks*